US006905545B2

(12) United States Patent
Tominaga

(10) Patent No.: US 6,905,545 B2
(45) Date of Patent: Jun. 14, 2005

(54) TRANSFER DEVICE

(75) Inventor: Mitsuhiro Tominaga, Osaka (JP)

(73) Assignee: General Co., Ltd., Osaka (JP)

( * ) Notice: Subject to any disclaimer, the term of this patent is extended or adjusted under 35 U.S.C. 154(b) by 0 days.

(21) Appl. No.: 10/488,632

(22) PCT Filed: Jun. 19, 2002

(86) PCT No.: PCT/JP02/06130

§ 371 (c)(1),
(2), (4) Date: Mar. 3, 2004

(87) PCT Pub. No.: WO03/022600

PCT Pub. Date: Mar. 20, 2003

(65) Prior Publication Data

US 2004/0238677 A1 Dec. 2, 2004

(30) Foreign Application Priority Data

Sep. 7, 2001 (JP) ..... 2001/272394

(51) Int. Cl.[7] ..... B05C 1/14

(52) U.S. Cl. ..... 118/76; 118/257; 156/577; 156/579; 242/588; 242/588.3; 242/588.6; 400/695; 400/697

(58) Field of Search ..... 118/76, 257; 156/577, 156/579; 242/160.2, 160.4, 170, 171, 588, 588.3, 588.6; 400/695, 697

(56) References Cited

U.S. PATENT DOCUMENTS

| | | | | |
|---|---|---|---|---|
| 2,403,964 A | | 7/1946 | Bannon et al. | |
| 3,936,571 A | | 2/1976 | Van Hoof et al. | |
| 4,704,185 A | | 11/1987 | Fischer | |
| 5,430,904 A | * | 7/1995 | Ono et al. | 15/104.94 |
| 5,685,944 A | | 11/1997 | Nose et al. | |
| 5,735,999 A | | 4/1998 | Mendelovich et al. | |
| 5,759,341 A | * | 6/1998 | Kobayashi | 156/540 |
| 2004/0180196 A1 | | 9/2004 | Yamashita | |

FOREIGN PATENT DOCUMENTS

| | | |
|---|---|---|
| JP | S61-066772 | 4/1986 |
| JP | H03-273080 | 12/1991 |
| JP | H 04-046070 | 4/1992 |
| JP | H 05-239413 | 9/1993 |
| JP | H 05-311135 | 11/1993 |
| JP | H 06-008362 | 2/1994 |
| JP | H 07-267478 | 10/1995 |
| JP | H 09-001986 | 1/1997 |
| JP | H 09-071097 | 3/1997 |
| JP | 2000-204328 | 7/2000 |
| JP | 2001-098233 | 4/2001 |
| JP | 2001-192625 | 7/2001 |
| JP | 2001-240812 | 9/2001 |

* cited by examiner

*Primary Examiner*—Laura Edwards
(74) *Attorney, Agent, or Firm*—Brinks Hofer Gilson & Lione

(57) ABSTRACT

Provided is a transfer device capable of maintaining a constant tension of band-shaped ribbon from the start till the end of operation requiring no action by a user. While band-shaped ribbon (F) is being supplied, a feed shaft unit (4) and a feed drive gear (3) rotate. In accordance with their rotations, a movable plate (6) screw-retreats so that the interval between the movable plate (6) and the surface of the feed drive gear (3) is increased in the axial direction. Consequently, the force of a coil spring (5) is reduced and the braking force (a force to press the surface of the feed drive gear (3) to stop its rotation) is gradually decreased.

3 Claims, 8 Drawing Sheets

TRANSFER DEVICE

TECHNICAL FIELD

The present invention relates to a transfer device maintaining a constant tension of band-shaped ribbon from the beginning till the end of operation.

TECHNICAL BACKGROUND

Recently, a transfer device for transferring a coating film onto a transfer-receiving object such as paper has been widely used because of its advantageous feature of easy handling for supplying an adequate amount as a replacement for touch-up liquid and liquid paste. A transfer device applying a white correction film for touch-up makes a correction by transferring the correction film onto a correction point of a transfer-receiving object. A transfer device employing an adhesive film for adhesively connects the transfer-receiving object and an attachment substance fixes the attachment substance to the adhesive film transferred onto the transfer-receiving object.

Both types of the above-described transfer devices have similar structures except for the coating film used which is adhesive or white. More specifically, such a transfer device includes a feed shaft unit, a roll up shaft unit and a transfer unit within a casing. The feed shaft unit rotates to supply band-shaped ribbon coated with a coating film. The roll up shaft unit rotates to wind up the band-shaped ribbon after transferring the coating film onto a transfer-receiving object.

The roll up shaft unit and the feed shaft unit engage with each other by means of, for example, gears, and thus the roll up shaft unit rotates in accordance with the revolution of the feed shaft unit while the band-shaped ribbon is being supplied. The transfer unit is disposed projecting from an opening formed at an end of the casing. The transfer unit pulls out the band-shaped ribbon coated with coating film from the feed shaft unit, transfers the coating film onto the transfer-receiving object, and then sends the band-shaped ribbon to the roll up shaft unit.

In the transfer device of this type, malfunction occurs if the tension of the band-shaped ribbon in the region between the feed shaft unit and the roll up shaft unit (hereinafter referred to as "tension") is too high or too low. More specifically, when the tension is too low, the band-shaped ribbon may be loosened and the feed shaft unit may fail to rotate engagedly with the roll up shaft unit. Reversely, when the tension is too high, an additional force is required for supplying or winding up the band-shaped ribbon (hereinafter referred to as "traveling") is required and in an extreme case the band-shaped ribbon is broken up.

To cope with this problem, the feeding rotation of the feed shaft unit in a typical transfer device is loaded so as to prevent at least extreme lowering of the tension (hereinafter referred to as "braking force"). This method, however, has a following drawback, as the braking force is kept constant from the beginning till the end of operation.

At the initial period of operation, the traveling is smooth as the rolling diameter of the feed shaft unit is large. At the end of operation, however, the tension of the band-shaped ribbon is higher compared with the standard tension during the normal traveling at the start, since the roll diameter of the feed shaft unit becomes smaller at the end than the roll diameter of the feed shaft unit at the start, which makes the traveling to be heavy.

Such a tension fluctuation of the band-shaped ribbon from the beginning till the end of operation deteriorates the maneuverability of the transfer device for the user, making handling of the device to be difficult. Thus, it is required to maintain a constant tension of the band-shaped ribbon from the beginning till the end of operation for improving the maneuverability.

An example of a transfer device in which the tension of the band-shaped ribbon is kept constant has been proposed in Japanese laid-open patent publication No. 9-71097, having the following structure. A supply reel collar (feed shaft unit) having an L-shaped section is disposed on an upper surface of a supply gear opposite to the gear in the direction of the shaft center. A spring is wound around the shaft center of the supply gear within the space between the L-shaped section of the supply reel collar and the shaft center of the gear.

A pressing plate is fittingly provided around the shaft center of the supply gear to contact with the spring at the side opposite to the side at which the spring contacts with the supply gear and to slide along the shaft center of the supply gear. Further, a female screw is formed at the upper inside of the shaft center of the supply gear, into which screw a variable button is threaded.

According to the structure of the transfer device disclosed in above Japanese laid-open patent publication No. 9-71097, the user adjusts the tension of the band-shaped ribbon by screwing the variable button into and out of the shaft center of the supply gear appropriately and arbitrarily. In other words, the user alters the interval between the pressing plate and the supply gear by operating the variable button during use.

When the interval is decreased by controlling the variable button, the supply reel collar is allowed to press the surface of the supply gear by the force of the spring. The braking force is simultaneously applied to the rotation of the supply reel collar. When the interval is increased by operating the variable button, the above braking force is reduced leaving a predetermined amount of the spring force applied.

However, according to the structure of Japanese laid-open patent publication No. 9-71097 described as above in which the tension of the band-shaped ribbon can be varied, the user is required to manipulate the variable button appropriately, which requirement forced on the user deteriorates the convenient feature of the transfer device. Moreover, since the user is not particularly conscious of the relationship between the amount of use and the tension of the band-shaped ribbon, it is extremely difficult to actually keep the tension of the band-shaped ribbon constant.

The object of the present invention is to solve the above problem, providing a transfer device capable of maintaining a constant tension of a band-shaped ribbon from the beginning till the end of operation requiring no action by a user.

SUMMARY OF THE INVENTION

The transfer device of the present invention can be embodied by constructing it in the following manner. A feed shaft and a roll up shaft are provided inside a casing. A feed drive gear is supported on the feed shaft. A feed shaft unit around which band-shaped ribbon coated with coating film is wound is supported on the outer periphery of the axially extended portion of the feed drive gear which is coaxial with the feed shaft. Similarly, a roll up drive gear mating with the above feed drive gear is supported on the roll up shaft. A roll up shaft unit which winds up the band-shaped ribbon after transferring coating film onto a transfer-receiving object is supported on the outer periphery of the axially extended portion of the roll up drive gear which is coaxial with the roll up shaft.

In a structure as an example, the feed shaft unit and the feed drive gear are formed integrally, and a screw-shaped advance/retreat portion, for example, is formed on the inner periphery of a portion of the feed drive gear which portion extends axially along the feed shaft. A coil spring having a spring force in the axial expanding direction is fittingly provided between, for example, the outer periphery of the feed drive gear and the inner periphery of the feed shaft unit. The coil spring is compressed by a movable plate which can be screwed into the above advance/retreat portion.

According to the transfer device having the above structure, the surface of the feed drive gear is pressed by the force of the spring and thus the maximum braking force is applied to the feed drive gear. Since the roll diameter of the feed shaft unit is large and the tension of the band-shaped ribbon is low in the initial operation period, the traveling is light. Thus, the maneuverability is not devalued even in the condition where the maximum braking force is given to the feed drive gear.

When the band-shaped ribbon is supplied, the feed shaft unit and the feed drive gear are rotated. The movable plate then screw-retreats from the feed drive gear little by little in accordance with the rotation of the feed drive gear. The interval between the movable plate and the feed drive gear is thus axially enlarged, which leads to gradual expansion of the spring coil and lowering of its force. The reduction of the spring force decreases the braking force applied to the feed drive gear.

Since the roll diameter of the feed shaft unit is smaller at the end of operation than the roll diameter of the feed shaft unit at the start, the tension of the band-shaped ribbon is high if the braking force is kept constant. According to the transfer device of the present invention, the coil spring is expanded and thus the spring force is gradually decreased at the end of operation, thereby the braking force being also progressively lowered. Consequently, the tension of the band-shaped ribbon at the end of operation is not increased, but kept equal to that at the initial period. The transfer device of the present invention is thus capable of maintaining a constant tension of the band-shaped ribbon from the beginning till the end of operation through this mechanism.

Additionally, the transfer device of the present invention can be constructed according to another following example having the above structure. The roll up shaft supports a roll up speed-reduction gear integrally overlapped on the roll up drive gear. The feed shaft supports a feed speed-reduction gear overlapped on the feed drive gear and engaged with the roll up speed-reduction gear. In this structure, the above-described advance/retreat portion (ex. screw-shaped) may be formed in a region of any of the feed shaft unit, feed drive gear and feed speed-reduction gear which region extends axially along the feed shaft, but preferably the advance/retreat portion is formed within the feed speed-reduction gear, the reason of which will be described below. Herein explained is an example of a structure in which the advance/retreat portion is provided within the feed speed-reduction gear.

The operation of the transfer device thus constructed is as follows. The feed shaft unit and the feed drive gear rotate while the band-shaped ribbon is being supplied, and the roll up shaft unit thus revolves by means of the roll up drive gear. The feed speed-reduction gear and the roll up speed-reduction gear simultaneously rotate while decreasing the rotations of the feed drive gear and the roll up drive gear. These actions of the feed speed-reduction gear and the roll up speed-reduction gear allow the above-described braking force to be lowered more slowly, which constantly provides stable handling of the transfer device according to the present invention. It is thus preferable to form the advance/retreat portion within the feed speed-reduction gear.

Furthermore, the transfer device of the present invention having the above structure can be constructed as follows. An intermediate speed-reduction gear is disposed between the feed speed-reduction gear and the roll up speed-reduction gear to mate with both gears. This structure allows the braking force to be decreased more slowly than in the above-described structures, and thus provides more stable manipulation compared with the above examples.

PREFERRED EMBODIMENTS OF THE INVENTION (First Embodiment)

Figure 1:
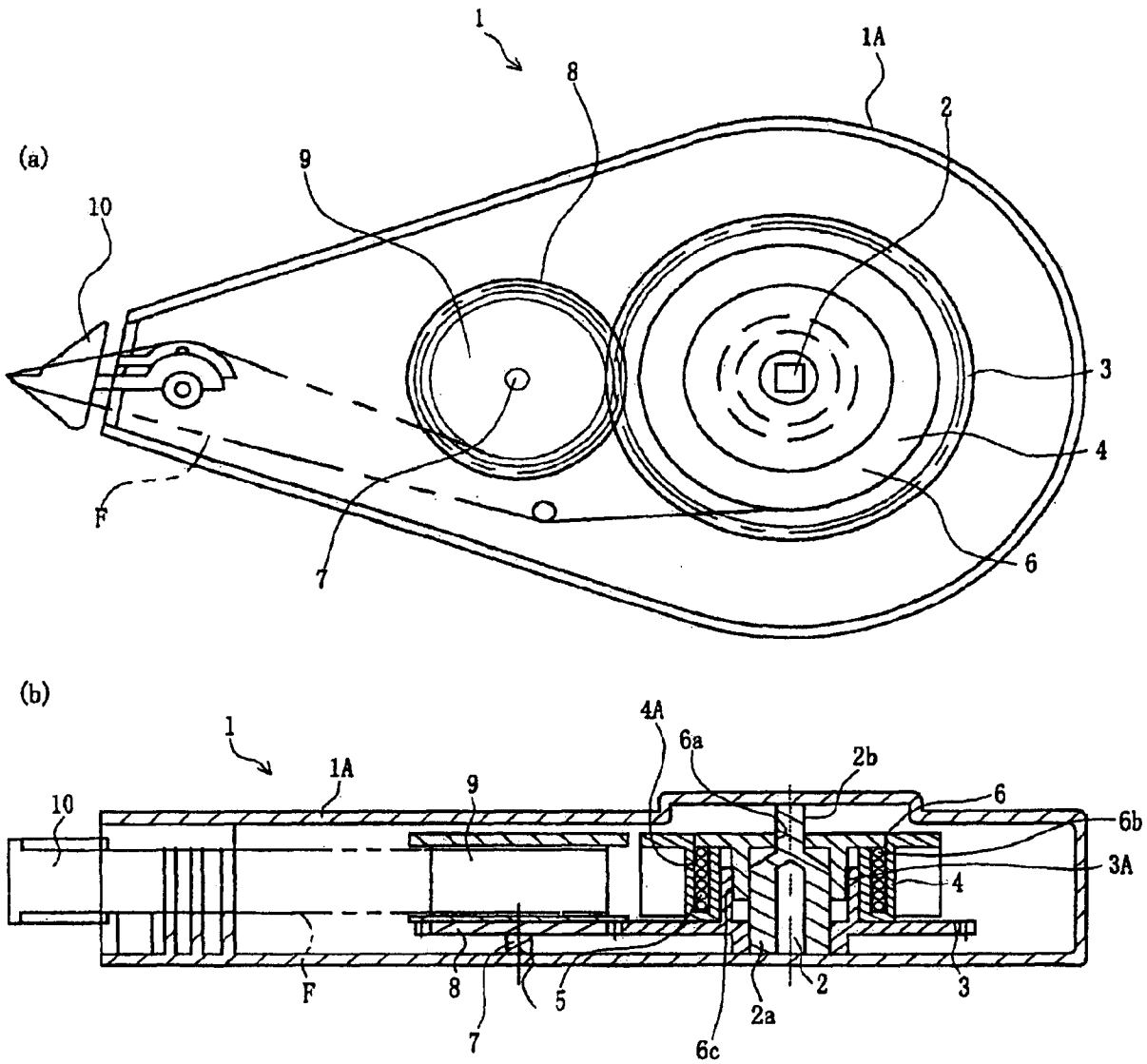
FIG. 1 illustrates a structure of a transfer device of a first embodiment of the present invention, in which (a) is a plan view and (b) is a vertical section view of (a).
Figure 2:
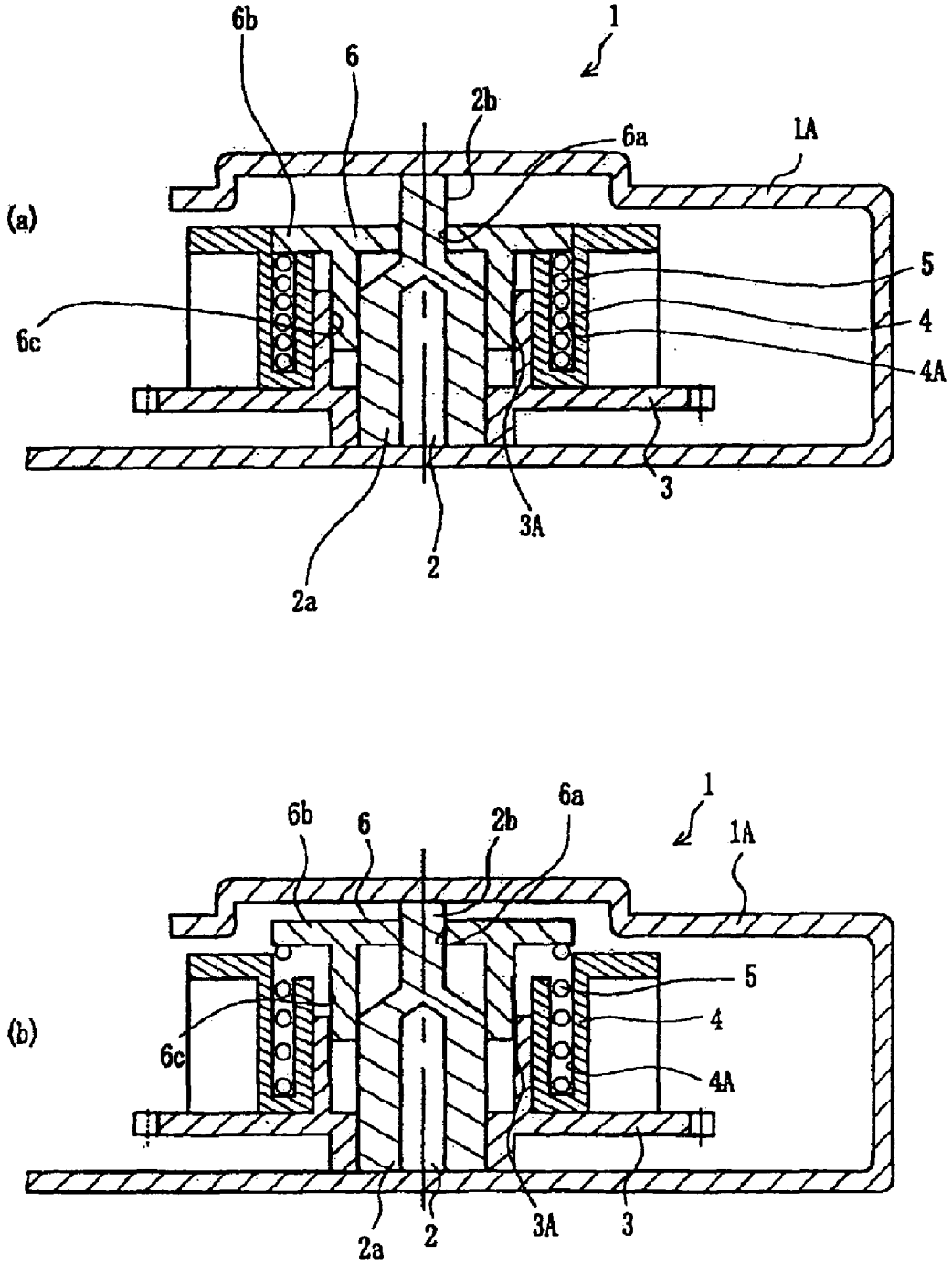
FIG. 2 illustrates the transfer device in use of the first embodiment of the present invention, in which (a) shows a partial enlarged vertical section view at the initial stage of operation, and (b) shows that view at the end of operation.

As shown in FIGS. 1 and 2, a transfer device 1 has the following structure of the present invention. A feed shaft 2 is provided within a casing 1A. The feed shaft 2 has a cylindrical shape in the lower portion viewed in FIG. 1(*b*) (hereinafter referred to as "feed shaft lower portion 2*a*") and has a solid prism shape in the upper portion viewed in that figure (hereinafter referred to as "feed shaft upper portion 2*b*").

A feed drive gear 3 is supported on the feed shaft lower portion 2*a*. The axial lower portion of the feed drive gear 3 contacts with the feed shaft lower portion 2*a*. The upper portion of the feed drive gear 3 axially extends, which extending portion is positioned away from the outer periphery of the feed shaft lower portion 2*a*. Further, a screw-shaped advance/retreat portion 3A (the area shown by a bold line is screw-shaped in the figure) is formed on the inner periphery of the above extending portion of the feed drive gear 3 facing to the outer periphery of the feed shaft lower portion 2*a*.

The inner periphery of a feed shaft unit 4 contacts with the outer periphery of the extending portion of the feed drive gear 3. A concave portion 4A which is open at the upper portion is formed around the shaft center within the feed shaft unit 4 adjacent to the outer periphery thereof. Band-shaped ribbon F coated with a coating film (not shown in the figures and by a reference number) is wound around the outer periphery of the feed shaft unit 4 having the concave portion 4A formed therein.

A coil spring 5 is compressedly inserted into the concave portion 4A of the feed shaft unit 4. The coil spring 5 as compressed has a constant force in the expanding direction. A movable plate 6 is screwed into the advance/retreat portion 3A of the feed drive gear 3, the rotation of which plate is controlled by the feed shaft upper portion 2*b*. The movable plate 6 has an opening 6*a* through which the feed shaft upper portion 2*b* is inserted. The opening 6*a* has, for example, a rectangular shape similarly to the shape of the feed shaft upper portion 2*b*.

The movable plate 6 also has a pressing portion 6*b* extending from the opening 6*a* as its center toward the outer periphery. The pressing portion 6*b* presses the coil spring 5 to close the open upper portion of the concave portion of 4A of the feed shaft unit 4. Also, a screw portion 6*c* (shown by a bold line in the figure) is formed on the outer periphery of the axially projecting region of the movable plate 6 at the side of the feed drive gear 3. The screw portion 6*c* is inserted into a space between the inner periphery of the axially extending portion of the feed drive gear 3 and the outer periphery of the feed shaft 2 and is screw-engaged with the advance/retreat portion 3A.

Thus, the movable plate 6 is screw-engaged with the feed drive gear 3. The movable plate 6, however, does not rotate together with the feed drive gear 3 since the opening 6*a* is engaged with the feed shaft upper portion 2*b*, but screw-advances and retreats in the axial direction.

A roll up shaft 7 is provided within the casing 1A. A roll up drive gear 8 is supported on the roll up shaft 7. The roll up drive gear 8 mates with the above-described feed drive gear 3. A roll up shaft unit 9 is formed integrally with the upper surface of the roll up drive gear 8 viewed in FIG. 1(*b*). The used band-shaped ribbon F after transferring the coating film onto the transfer-receiving object is wound around the periphery of the roll up shaft unit 9.

A transfer unit 10 is interposed between the travel distance from the feed shaft unit 4 to the roll up unit 9 while exposing from a part of the casing 1A. According to this embodiment, the coating film is a white correction film for correcting characters and the like on the transfer-receiving object, which film is applied to the band-shaped ribbon F. Thus, the transfer unit 10 is steeple-shaped.

In operation of the transfer device 1, the transfer unit 10 is pressed on the transfer-receiving object and moved in a direction orthogonal to the feed shaft 2 and the roll up shaft 7. The band-shaped ribbon F is supplied from the feed shaft unit 4, sent through the transfer unit 10, and wound around the roll up shaft unit 9. The feed drive gear 3 simultaneously rotates in accordance with the revolution of the feed shaft unit 4. The rotation of the feed drive gear 3 in turn rotates the roll up drive gear 8 engaged therewith, and accordingly the roll up shaft unit 9 rotates.

At the initial operation of the transfer device 1, the movable plate 6 is screwed into the advance/retreat portion 3A of the feed drive gear 3 to the maximum as shown in FIG. 2(*a*). Thus, the coil spring 5 compressed under this condition applies the maximum force to the surface of the feed drive gear 3 from the pressing portion 6*b* of the movable plate 6 as the base end through the concave portion 4A of the feed shaft unit 4. Accordingly, the maximum braking force is applied to the transfer device 1 at the initial stage of operation.

Thereafter, when the feed drive gear 3 rotates together with the feed shaft unit 4 by operating the transfer device 1, the screw portion 6*c* of the movable plate 6 screw-retreats from the advance/retreat portion 3A of the feed drive gear 3. Under this condition, the coil spring 5 pushes the movable plate 6 upward from the surface of the feed drive gear 3 as the base end through the concave portion 4A of the feed shaft unit 4. The movable plate 6 thus moves upward along the feed shaft 2.

Consequently, the spring force applied to the feed drive gear 3 is decreased as the coil spring 5 is gradually expanded during operation. The decrease in the force of the coil spring 5 in turn lowers the braking force given to the surface of the feed drive gear 3. The tension of the band-shaped ribbon F is thus reduced under this condition.

At the end period of operation, the roll diameter of the band-shaped ribbon F around the feed shaft unit 4 is smaller than the roll diameter at the starting period. Thus, the traveling is heavier and the tension applied to the band-shaped ribbon F is higher if the braking force is kept constant as in a prior-art transfer device. According to the transfer device 1 of the present invention, however, the braking force at the end of operation is lower than that force at the start of operation, and thus the tension applied to the band-shaped ribbon F is not increased.

As aforementioned, according to the transfer device 1 of the present invention, the tension of the band-shaped ribbon F is gradually decreased during use requiring no adjustment by the user. Thus, the transfer device 1 of the present invention maintains a constant tension of the band-shaped ribbon F from the start till the end of operation, thereby providing enhanced maneuverability.

(Second Embodiment)

Figure 3:
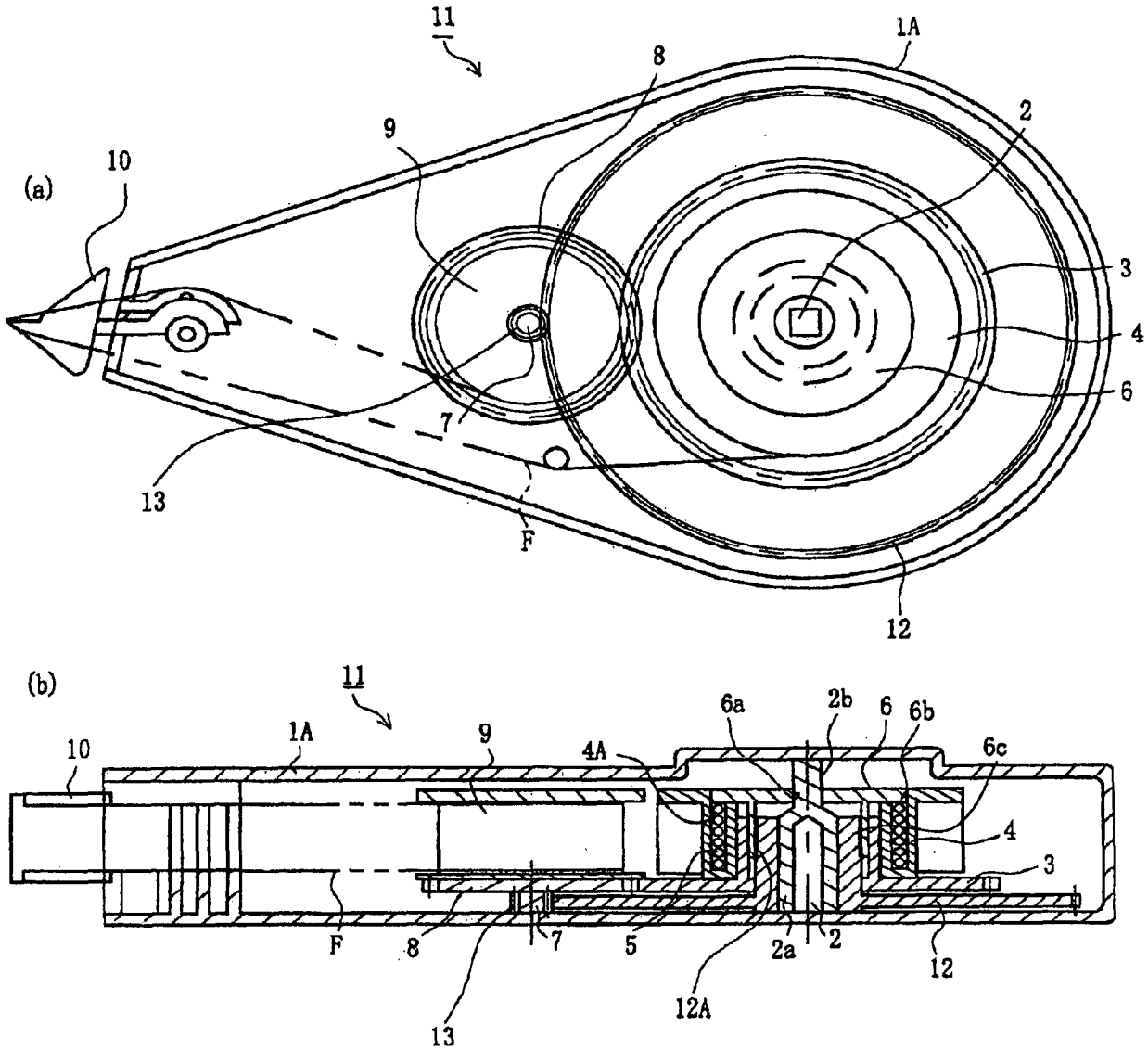
FIG. 3 illustrates a structure of a transfer device of a second embodiment of the present invention, in which (a) is a plan view and (b) is a vertical section view of (a).
Figure 4:
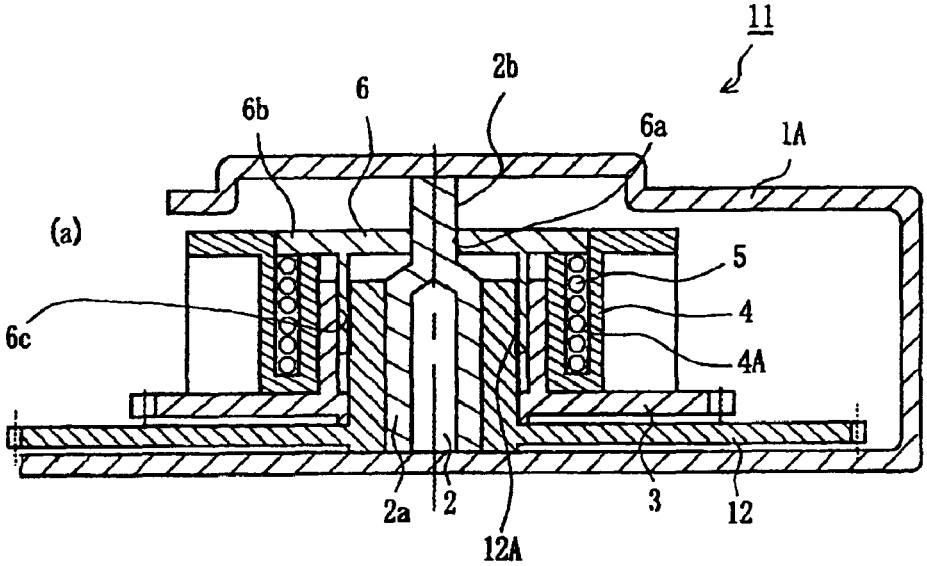
FIG. 4 illustrates the transfer device in use of the second embodiment of the present invention, in which (a) shows a partial enlarged vertical section view at the initial stage of operation, and (b) shows that view at the end of operation.
Figure 4:
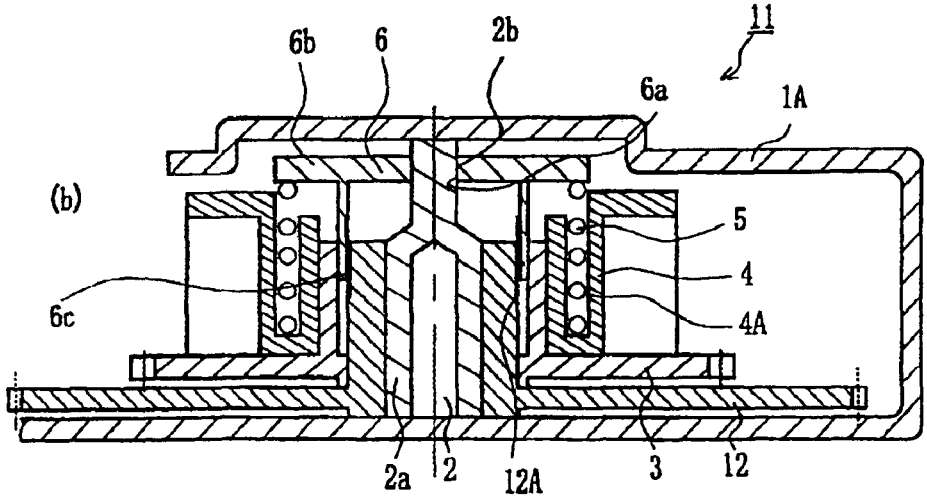

As shown in FIGS. 3 and 4, a transfer device 11 has a following structure in accordance with the present invention. Explained herein are only the different points between the structure of the transfer device 11 and that of the transfer device 1 of the first embodiment shown in FIGS. 1 and 2. A feed speed-reduction gear 12 is provided. The lower inner periphery of the feed speed-reduction gear 12 contacts the feed shaft lower portion 2*a*. The upper portion of the feed speed reduction gear 12 projects in the axial direction. An advance/retreat portion 12A (shown by a bold line) is formed on the outer periphery of the projecting portion of the feed speed-reduction gear 12.

In the transfer device 11, the screw portion 6*c* is formed on the inner periphery of the movable plate 6 so as to be screw-engaged with the advance/retreat portion 12A of the above feed speed-reduction gear 12. The feed drive gear 3 is inserted through the outer periphery of the feed speed-reduction gear 12 and positioned above the feed speed-reduction gear 12. Also, the lower shaft portion of the feed drive gear 3 contacts with the lower outer periphery of the feed speed-reduction gear 12.

Additionally, the inner periphery of the axial projecting portion of the feed drive gear 3 is positioned away from the outer periphery of the axially extending portion of the feed speed-reduction gear 12 to form a space therebetween, into which space the screw portion 6*c* of the movable plate 6 is inserted to bring screw-engagement between the screw portion 6*c* and the advance/retreat portion 12A. Also, the inner periphery of the axially projecting portion of the feed drive gear 3 contacts the outer periphery of the screw portion 6*c* of the movable plate 6. The outer periphery of the axially projecting portion of the feed drive gear 3 contacts the inner periphery of the feed shaft unit 4.

A roll up speed-reduction gear 13 is coaxial with the roll up shaft 7 and formed integrally with the lower surface of the roll up drive gear 8 as viewed in FIG. 3(*b*). The roll up speed-reduction gear 13 mates with the above feed speed-reduction gear 12.

More particularly, the feed speed-reduction gear 12 rotates around the feed shaft 2 in accordance with the rotation of the roll up speed-reduction gear 13. The feed drive gear 3 rotates in accordance with the rotation of the feed shaft unit 4 independently of the feed speed-reduction gear 12. The roll up shaft unit 4 rotates while the band-shaped ribbon F is being supplied. The roll up drive gear 8 (the roll up shaft unit 9) and the roll up speed-reduction gear 13 rotate in accordance with the rotation of the feed drive gear 3.

According to the transfer device 11 having the above structure, the feed shaft unit 4 and the feed drive gear 3 rotate when the band-shaped ribbon F is supplied during use. The rotation of the feed drive gear 3 revolves the roll up drive gear 8. The rotation of the roll up drive gear 8 rotates the roll up speed-reduction gear 13 and the roll up shaft unit 9. The feed speed-reduction gear 12 mating with the roll up speed-reduction gear 13 also rotates. The rotation of the feed speed-reduction gear 12 raises the movable plate 6, which screw-advances and retreats, by means of the screw structure.

Furthermore, the braking force arising from the spring force of the coil spring 5 is applied to the feed drive gear 3. As mentioned above, the braking force is gradually decreased during operation.

Thereafter, the transfer device 11 of the second embodiment provides an effect similar to that of the first embodiment described above in a similar manner. In the transfer device 11 of the second embodiment, the mechanism of the feed speed-reduction gear 12 and the roll up speed-reduction gear 13 slowly moves the movable plate 6 upward by means of the screw structure in accordance with the rotation of the feed drive gear 3. The braking force thus decreases more slowly, realizing smoother handling of the transfer device 11 compared with the transfer device 1 of the first embodiment.

(Third Embodiment)

Figure 5:
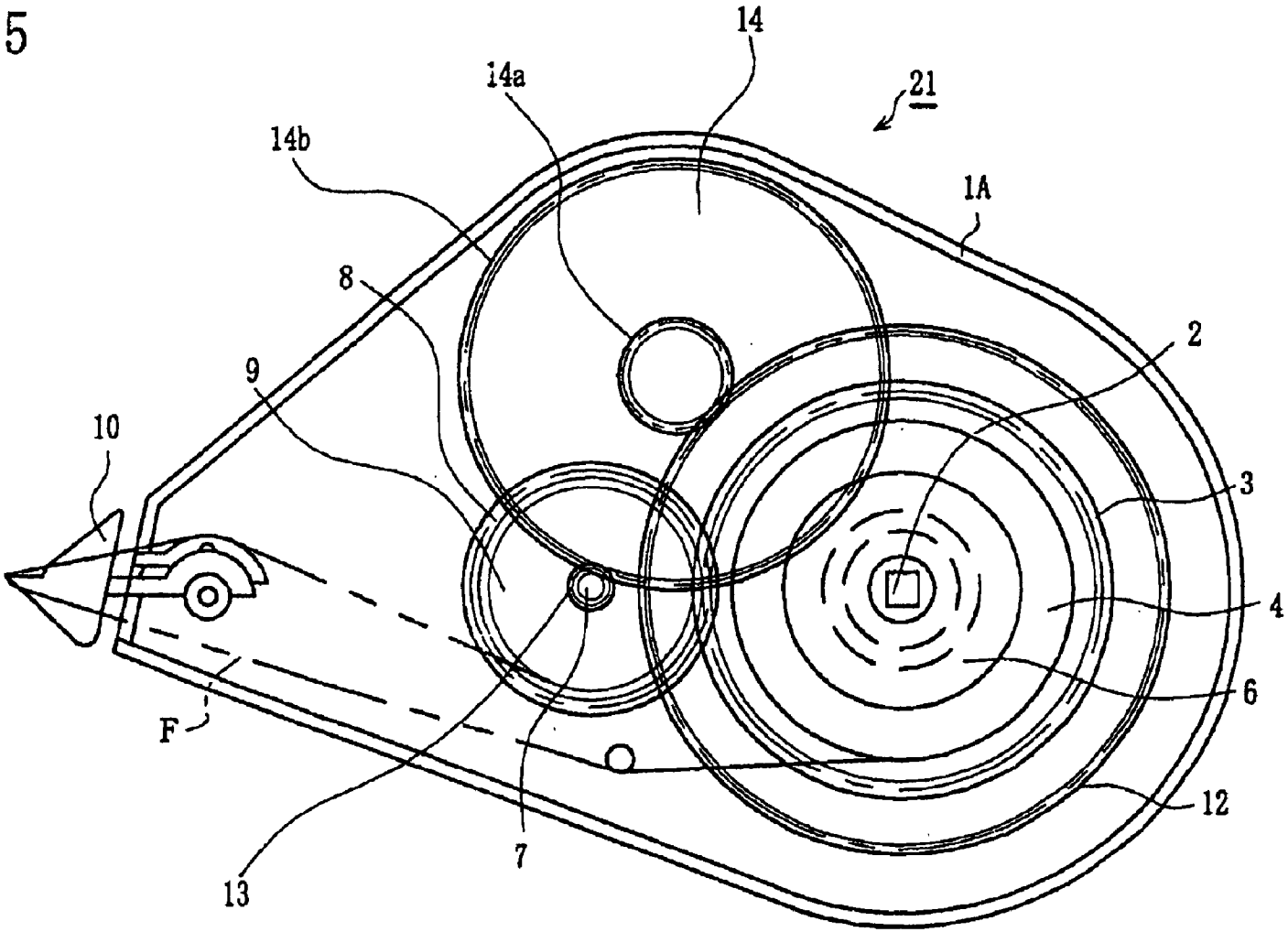
FIG. 5 is a plan view showing a structure of a transfer device of a third embodiment of the present invention.
Figure 6:
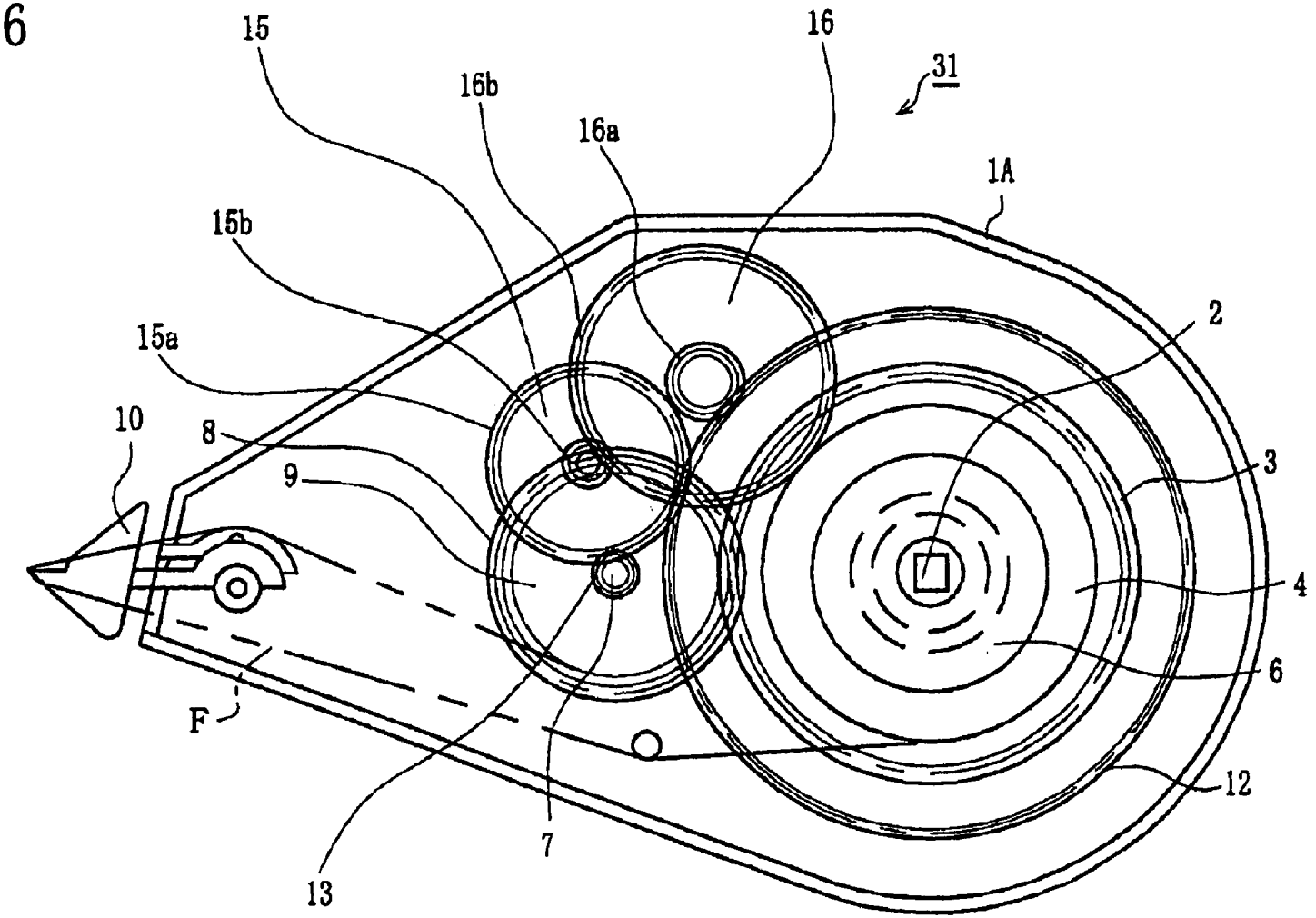
FIG. 6 is a plan view showing another structure of the third embodiment of the present invention.

As illustrated in FIGS. 5 and 6, transfer devices 21 and 31 have the following structures according to the present invention. Explained first is the structure of the transfer device 21 only at the points different from those of the transfer device 11 of the second embodiment as shown in FIGS. 3 and 4. In the transfer device 21, the feed speed-reduction gear 12 and the roll up speed-reduction gear 13 does not engage with each other, between which gears an intermediate speed-reduction gear 14 is interposed.

The intermediate speed-reduction gear 14 consists of an upper member 14*a* having a smaller diameter and mating with the feed speed-reduction gear 12, and a lower member 14*b* having a larger diameter and mating with the roll up speed-reduction gear 13. The intermediate speed-reduction gear 14 integrally connects the upper member 14*a* and the lower member 14*b*. The feed speed-reduction gear 12 and the roll up speed-reduction gear 13 both have appropriate heights capable of engaging with the upper member 14*a* and the lower member 14*b* according to their axial heights, respectively.

In the transfer device 31, on the other hand, the feed speed-reduction gear 12 and the roll up speed-reduction gear 13 does not engage with each other, between which gears intermediate speed-reduction gears 15 and 16 are provided. The intermediate speed-reduction gear 15 is composed of an upper member 15*a* having a larger diameter and mating with the roll up speed-reduction gear 13, and a lower member 15*b* having a smaller diameter. The intermediate speed-reduction gear 16 is composed of an upper member 16*a* having a smaller diameter mating with the feed speed-reduction gear 12, and a lower member 16*b* having a larger diameter and mating with the lower member 15*b* of the intermediate speed-reduction gear 15.

The intermediate speed-reduction gears 15 and 16 engage with the upper members 15*a* and 16*a* as well as the lower members 15*b* and 16*b*, respectively. The feed speed-reduction gear 12 and the roll up speed-reduction gear 13 have appropriate heights capable of mating with the upper members 15*a* and 16*a* and the lower members 15*b* and 16*b* of the intermediate speed-reduction gears 15 and 16 according to their axial heights, respectively.

According to the structures shown in FIGS. 5 and 6, the braking force can be reduced more slowly than that in the second embodiment as shown in FIGS. 3 and 4. The traveling is thus smoother while keeping the tension of the band-shaped ribbon F constant compared with that in the second embodiment described above.

Hereinafter described are experiments carried out for checking the effect of the present invention.

In the experiments, compared were the transfer device 21 of the third embodiment illustrated in FIG. 5 (hereinafter referred to as "embodiment") under the conditions below and a comparison example having different structures except for the construction of the drive gears and the speed-reduction gears which is the same as that of the transfer device 21.

Both of the embodiment and the comparison example have the following gear structure. The reference numerals of the transfer device 21 in FIG. 5 are used to specify each of the gears. The feed drive gear 3 has 60 teeth; the feed speed-reduction gear 12 has 70 teeth; the roll up drive gear 8 has 32 teeth; the roll up speed-reduction gear 13 has 7 teeth; the upper member 14*a* of the intermediate speed reduction gear 14 has 7 teeth; and the lower member 14*b* of the intermediate speed-reduction gear 14 has 50 teeth.

Under these conditions, the tension of the band-shaped ribbon F was measured at the start and the end of operation for three transfer devices each for the embodiment and the comparison example, the results of which are shown in Table 1. The roll diameter of the feed shaft unit 4 of both the embodiment and the comparison example is 28.7 mm at the start, and 17.0 mm at the end.

TABLE 1

| | Embodiment | | Comparison Example | |
|---|---|---|---|---|
| | Start | End | Start | End |
| 1 | 80–100 gf | 80–100 gf | 80–100 gf | 170–180 gf |
| 2 | 90–110 gf | 80–100 gf | 80–100 gf | 150–170 gf |
| 3 | 90–100 gf | 90–100 gf | 80–110 gf | 170–180 gf |

As shown in the table, the range of fluctuation in the tension of the band-shaped ribbon F from the start till the end of use was smaller in the transfer device of the embodiment than in the comparison example, providing stable handling of the transfer device.

Figure 7:
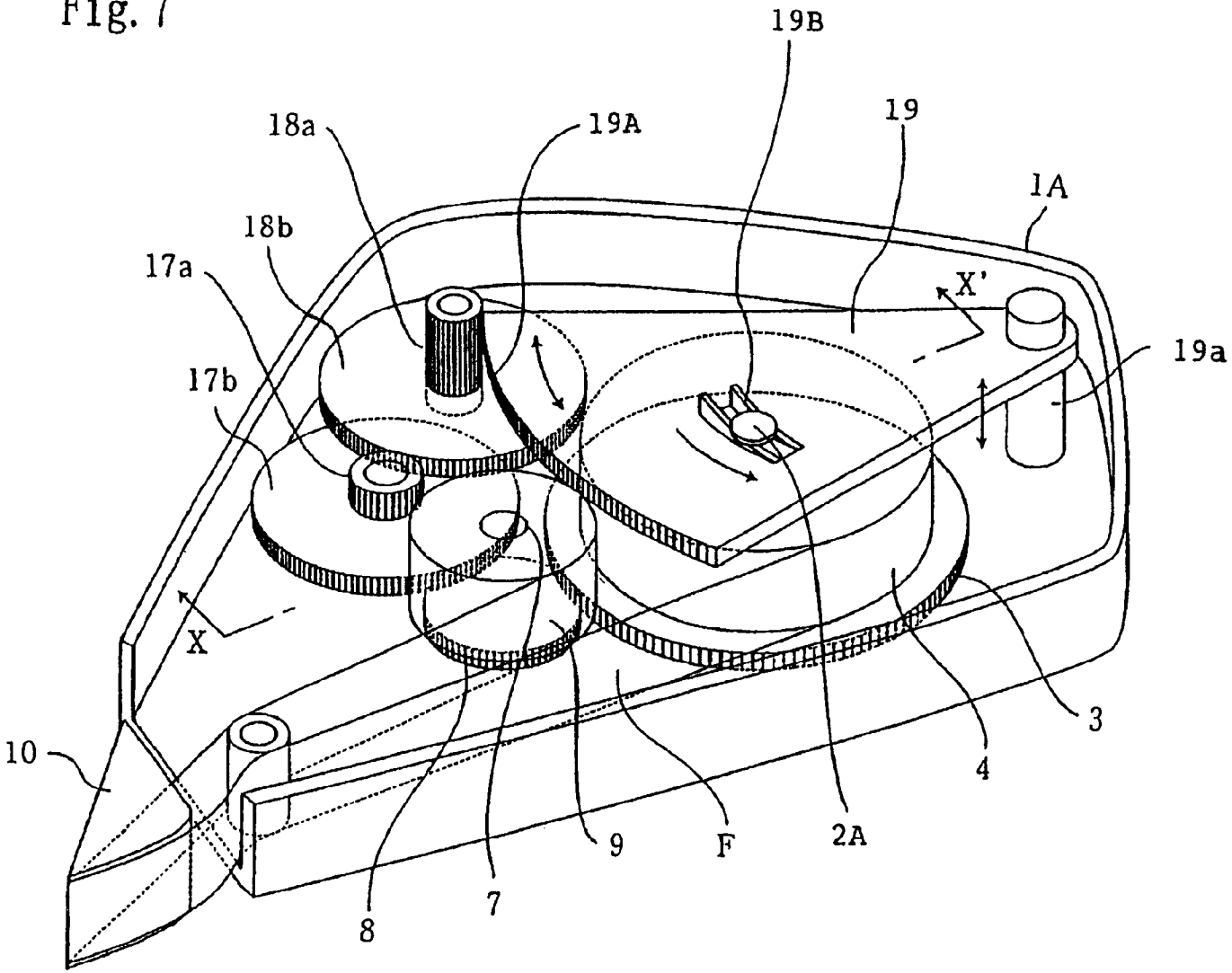
FIG. 7 is a perspective view showing a structure of a modified example of the transfer device of the present invention.
Figure 8:
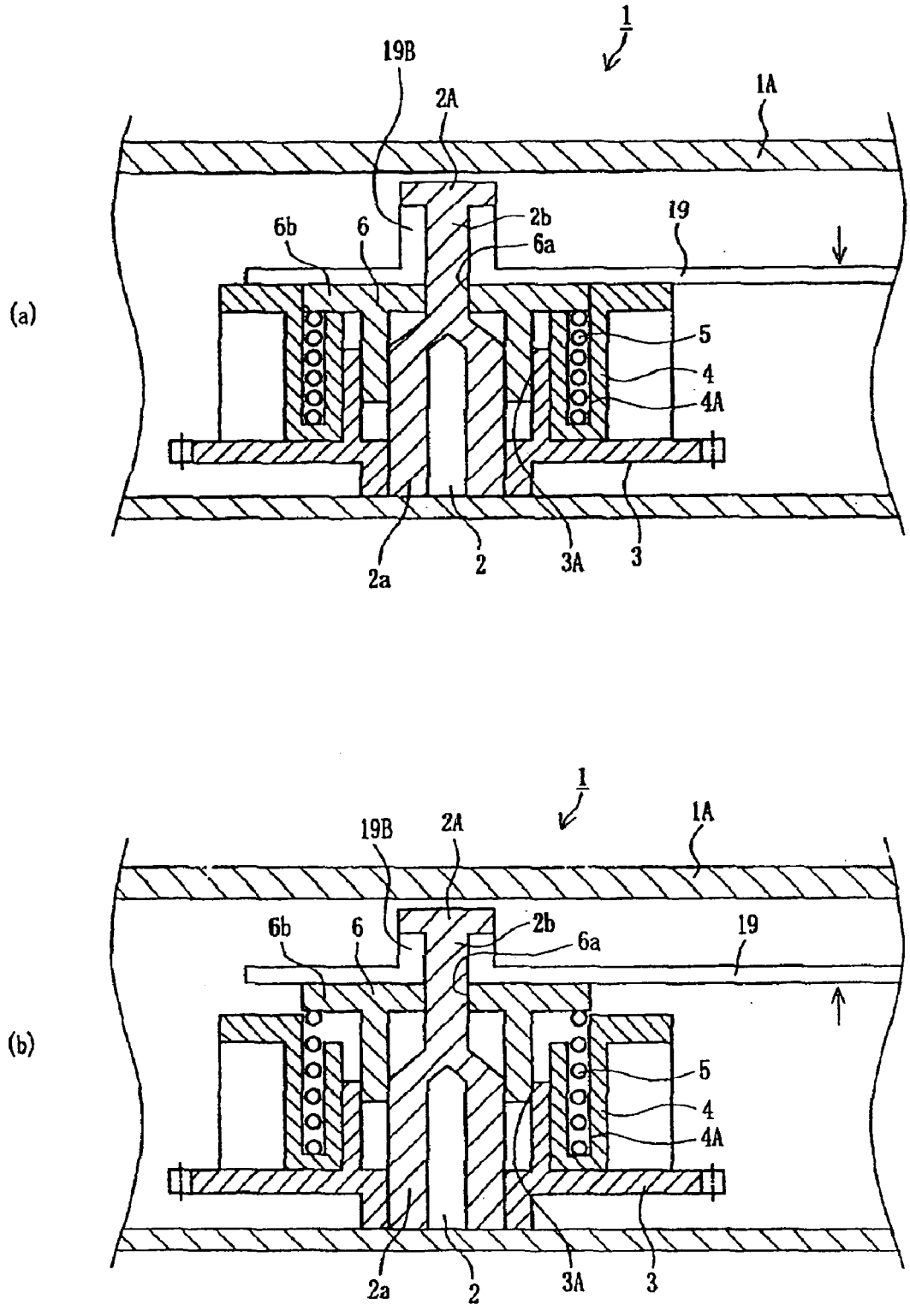
FIG. 8 illustrates the transfer device in use of the modified example of the present invention, in which (a) shows a partial enlarged vertical section view at the initial stage of operation, and (b) shows that view at the end of operation.

Furthermore, the present invention may be modified as illustrated in FIGS. 7 and 8. These figures show transfer devices in which the advance/retreat portion 3A of the structure according to the first embodiment shown in FIGS. 1 and 2 is modified. Explained below are only the points in the structure in FIGS. 7 and 8 which are different from the structure of the first embodiment. The advance/retreat portion 3A is not screw-shaped, but only a space into which the feed shaft 2 is inserted. Thus, the inner periphery of the upward extending portion of the feed drive gear 3 is not screw-shaped.

An engagement portion 2A is formed at the upper end of the feed shaft upper portion 2*b* of the feed shaft 2. A moving plate 19 is overlaid on the upper surface of the movable plate 6. The moving plate 19 is supported rotatably and movably upward and downward by the support 19*a* provided within the casing 1A. The moving plate 19 also has a rack 19A formed at the end opposite to the side supported by the support 19*a*. The rack 19A mates with an upper member 18*a* described later.

Furthermore, the moving plate 19 is provided with an opening, on the upper surface around which a slope 19B is mounted. The engagement portion 2A of the feed shaft upper portion 2*b* inserted through the above opening is engaged with the slope upper end surface of the slope 19B to be movable on the slope upper end surface.

Intermediate speed-reduction gears 17 and 18 are equipped within the casing 1A. A lower member 17*b* of the intermediate speed-reduction gear 17 mates with the roll up drive gear 8. An upper member 17*a* of the intermediate speed-reduction gear 17 mates with a lower member 18*b* of the intermediate speed-reduction gear 18. The upper member 18*a* of the intermediate speed-reduction gear 18 mates with the above-mentioned rack 19A of the moving plate 19.

In the above construction, the moving plate 19 is positioned such that the engagement portion 2A is located on the higher area of the slope 19B in the initial operation period as illustrated in FIG. 8(*a*). Under this condition, the movable plate 6 is pressed downward through the moving plate 19, and the coil spring 5 is thus compressed by means of the pressing portion 6*b*. Accordingly, a large braking force is applied to the feed drive gear 3.

During operation, the feed drive gear 3, the roll up drive gear 8, the intermediate speed-reduction gear 17 and the intermediate speed-reduction gear 18 rotate in this order. The rack 19A is moved in accordance with the rotation of the upper member 18*a* of the intermediate speed-reduction gear 18 and thus the moving plate 19 is moved every time the transfer device is operated. The movement of the slope 19B in accordance with the movement of the moving plate 19 allows the engagement portion 2A to move toward the lower area of the slope 19B which expand the compressed spring coil 5, moving the movable plate 6 upward by its spring force. Consequently, the braking force applied to the feed drive gear 3 is gradually lowered, providing operational effect similar to that in the above first embodiment.

Additionally, other modifications may be given to the present invention. For example, up to two intermediate speed-reduction gears are equipped in the above embodiments, but more such gears may be employed. Also, the screw-engagement structure between the screw portion 6*c* of the movable plate 6 and the advance/retreat portion 3A or 12A of the feed drive gear 3 or the feed speed-reduction gear 12, respectively, may be formed either on the inner or outer periphery of the screw portion 6*c* of the movable plate 6.

Furthermore, the insertion position of the coil spring 5 is not specified in particular if the spring 5 is disposed between the pressing portion 6*b* of the movable plate 6 and the surface of the feed drive gear 3 to apply its force therebetween. Also, the positional upper-lower relationship between the feed drive gear 3 and the feed speed-reduction gear 12 is not particularly limited to that as illustrated in FIGS. 3(*b*) and 4. In these modified examples, operational effect similar to that in the above-described embodiments can be obtained.

INDUSTRIAL APPLICABILITY

As aforementioned, in the transfer device of the present invention the braking force at the beginning of operation gradually decreases as the transfer device is operated. Therefore, the tension of the band-shaped ribbon from the start till the end of operation can be kept equal to the tension at the start, maintaining constant traveling and maneuverability.

Moreover, the transfer device of the present invention is provided with the feed speed-reduction gear and the roll up speed-reduction gear in addition to the above-described structure. These gears allow the braking force to be reduced more slowly as well as the above operational effect, which provides stable manipulation all the time.

Additionally, the transfer device of the present invention including the intermediate speed-reduction gear interposed between the feed speed-reduction gear and the roll up speed-reduction gear to mate with both gears can be more stably operated compared with the above transfer devices.

What is claimed is:

1. A transfer device, provided with a feed shaft formed within a casing for supporting a feed shaft unit around which band-shaped ribbon coated with a coating film is wound and a feed drive gear, and a roll up shaft formed within said casing for supporting a roll up shaft unit around which said band-shaped ribbon after transferring said coating film onto a transfer-receiving object is wound and a roll up drive gear mating with said feed drive gear, characterized by comprising an advance/retreat portion formed in an axially extending portion of said feed shaft unit or said feed drive gear which are rotated while said band-shaped ribbon is being supplied, a movable plate provided coaxially with said advance/retreat portion for advancing and retreating in the axial direction of said feed shaft in accordance with the rotation of said feed shaft, and a spring disposed within a space between said movable plate and a surface of said feed drive gear for providing a spring force to enlarge said space in the axial direction.

2. A transfer device as claimed in claim 1, comprising a roll up speed-reduction gear coaxial with said roll up shaft and integral with said roll up drive gear and a feed speed-reduction gear coaxial with said feed shaft and overlapped with said feed drive gear, and characterized in that said advance/retreat portion is defined within an axially extending portion of any of said feed shaft unit, said feed drive gear and said feed speed-reduction gear.

3. A transfer device as claimed in claim 2, characterized in that an intermediate speed-reduction gear is interposed between said feed speed-reduction gear and said roll up speed-reduction gear to mate with both gears.

* * * * *